US005572928A

United States Patent [19]

Negishi

[11] Patent Number: 5,572,928

[45] Date of Patent: Nov. 12, 1996

[54] ROTARY STENCIL PRINTING MACHINE

[75] Inventor: Hideo Negishi, Tokyo, Japan

[73] Assignee: Riso Kagaku Corporation, Tokyo, Japan

[21] Appl. No.: 402,062

[22] Filed: Mar. 9, 1995

[30] Foreign Application Priority Data

Mar. 14, 1994 [JP] Japan ..... 6-042655

[51] Int. Cl.[6] ..... B41L 13/06

[52] U.S. Cl. ..... 101/119; 101/116; 101/120

[58] Field of Search ..... 101/116, 117, 101/118, 120, 128, 128.1, 128.21, 128.4, 127, 127.1, 129, 119

[56] References Cited

U.S. PATENT DOCUMENTS

| | | | |
|---|---|---|---|
| 5,060,567 | 10/1991 | Hayama et al. | 101/120 |
| 5,152,218 | 10/1992 | Ishikawa | 101/118 |
| 5,172,632 | 12/1992 | Kobayasi et al. | 101/120 |
| 5,285,724 | 2/1994 | Kobayasi et al. | 101/120 |

FOREIGN PATENT DOCUMENTS

| | | |
|---|---|---|
| 552154 | 5/1932 | Germany . |
| 2014905 | 9/1979 | United Kingdom . |
| 2098927 | 12/1982 | United Kingdom . |

*Primary Examiner*—Edgar S. Burr
*Assistant Examiner*—Daniel J. Colilla
*Attorney, Agent, or Firm*—Kanesaka & Takeuchi

[57] ABSTRACT

A rotary stencil printing machine is formed of a cylindrical member, a clamping device formed on the cylindrical member for clamping a leading edge portion of a stencil sheet, and a back-up device provided outside the cylindrical member. The back-up device grips a printing sheet together with the cylindrical member to transfer the same. The cylindrical member includes a cylindrical peripheral surface for mounting thereon the stencil sheet; a first ink-pervious area formed on the peripheral surface on which an image forming area of the stencil sheet is disposed; at least one second ink-pervious area formed on the peripheral surface on which a trailing edge portion of the stencil sheet is disposed; and at least two first ink-impervious areas formed on the peripheral surface. The second ink-pervious area has an elongated shape continuously extending parallel to a center axis of the cylindrical member, and the ink-impervious areas sandwiches the second ink-pervious area.

4 Claims, 2 Drawing Sheets

ROTARY STENCIL PRINTING MACHINE

BACKGROUND OF THE INVENTION

The present invention relates to a stencil printing machine having a cylindrical printing drum and, more particularly, to a construction for preventing ink leakage at the rear end part of the printing drum.

There have been proposed various constructions for prevention of ink leakage in stencil printing machine. For example, the present applicant proposes in Japanese Patent Application No. Sho 55-126933 the prevention of ink leakage at the rear end part in the direction of rotation of an ink-pervious area of a printing drum. According to this invention, an ink dam element is provided along the axial line of the printing drum at the rear end part in the direction of rotation of the ink-pervious area of the printing drum, whereby excessive ink carried backward by the rotation of the drum without being used for printing is held to be fed back into the printing drum.

However, there is such a problem that when there remains too much surplus ink not used for printing due to a small printing area of a perforated image on a stencil sheet, the surplus ink flows out over the ink dam element in the case of the structure provided with the ink dam element previously proposed. The ink flowing out over the rear end of the ink-pervious area will smear the printing paper and the stencil printing machine as well.

SUMMARY OF THE INVENTION

It is, therefore, an object of the present invention to provide a rotary stencil printing machine which is capable of performing printing with a stencil sheet wrapped around the surface of a printing drum and reliably preventing ink leakage at the rear end part of an ink-pervious area.

The rotary stencil printing machine according to A first aspect of the invention comprises:

(a) cylindrical member rotatable on the center axis of its own and wrapped around its peripheral surface with a stencil sheet, said cylindrical member having a first ink-pervious area corresponding to a perforated image area of said stencil sheet mounted, at least one second ink-pervious area corresponding to the trailing edge part of said stencil sheet mounted and at least two ink-impervious areas enclosing said second ink-pervious area;

(b) a clamping device provided on the peripheral surface of said cylindrical member, for clamping the leading edge part of said stencil sheet; and (c) a back-up means provided outside of said cylindrical member, for gripping to carry a printing sheet in cooperation with said cylindrical member.

The rotary stencil printing machine stated in a second aspect is a rotary stencil printing machine stated in the first aspect, and further comprising:

(a) said cylindrical member including a first ink-pervious member around which said stencil sheet is wrapped, and an at least two-layer ink-pervious member of a second ink-pervious member provided therein;

(b) at least one second ink-pervious area enclosed with at least two ink-impervious areas in a part of said second ink-pervious member corresponding to the trailing edge part of said stencil sheet; and (c) an ink-impervious area for covering said second ink-pervious area in a part of said first ink-pervious member corresponding to the trailing edge part of said stencil sheet.

The rotary stencil printing machine stated in a third aspect is the rotary mimeograph apparatus stated in the second aspect, wherein the back-up means is a cylindrical body which rotates, in an opposite direction of the aforesaid cylindrical member, on the center of the axial line parallel with the axial line of the cylindrical member.

The cylindrical member and the back-up member grip and transfer the printing sheet, on which printing is done. With printing, excess ink is moved backwards in the direction of rotation of the cylindrical member. The excess ink is fed back into the cylindrical member from the second ink-pervious area provided in the ink-impervious area on the rear peripheral surface in the direction of rotation of the cylindrical member.

The above and other objects, features and advantages of the present invention will become clearer from the following description with reference to the accompanying drawings.

DETAILED DESCRIPTION OF THE PREFERRED EMBODIMENTS

Preferred embodiments of the present invention will be explained with reference to FIGS. 1 to 5.

Figure 1:
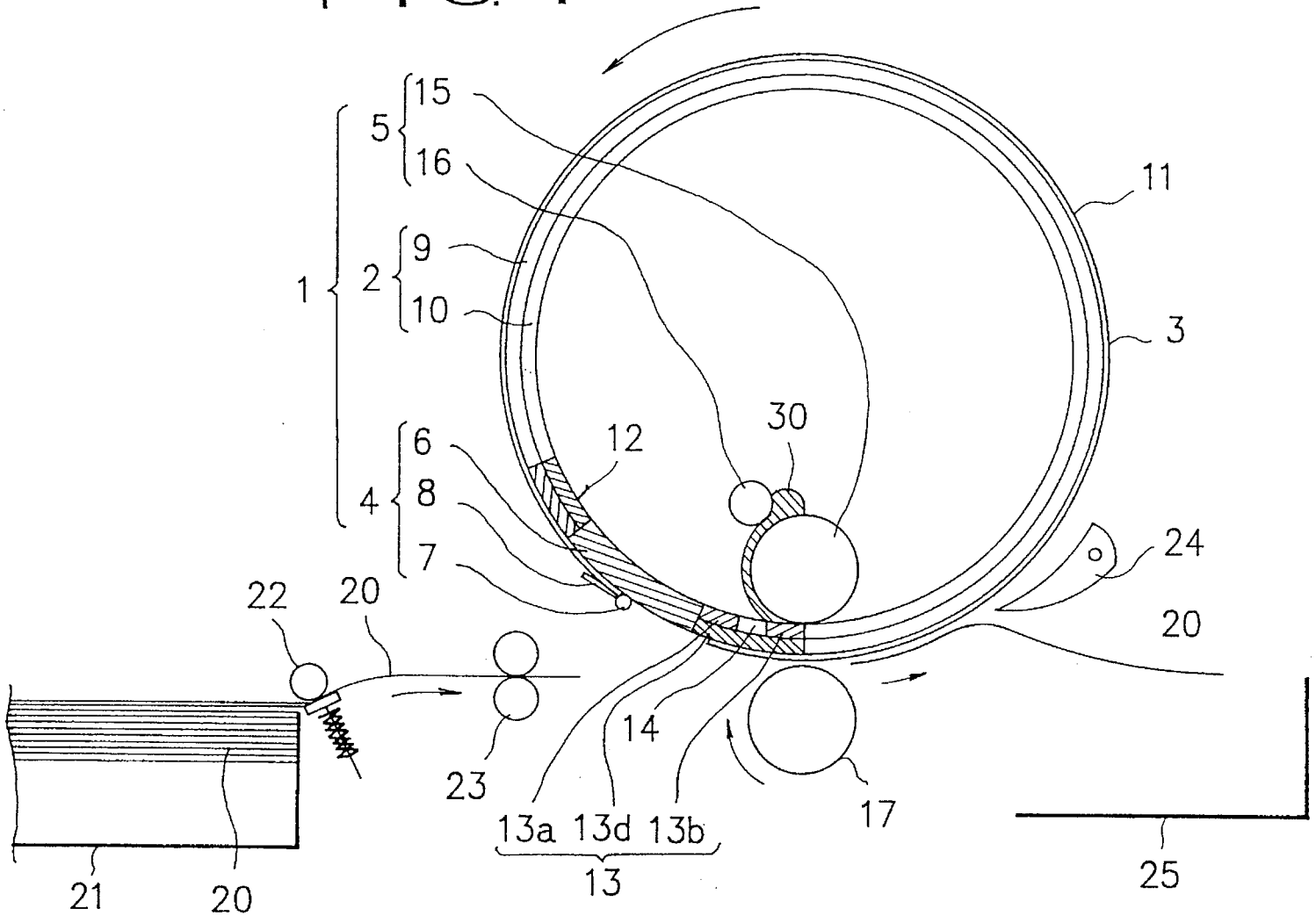
FIG. 1 is a sectional view of a first embodiment of the present invention.
Figure 2:
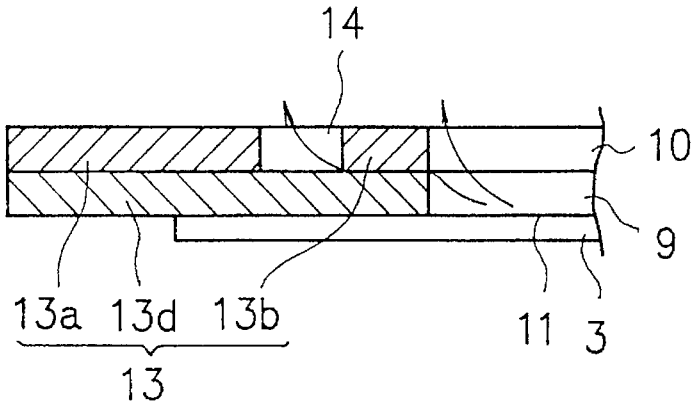
FIG. 2 is a partly enlarged view of FIG. 1.
Figure 3:
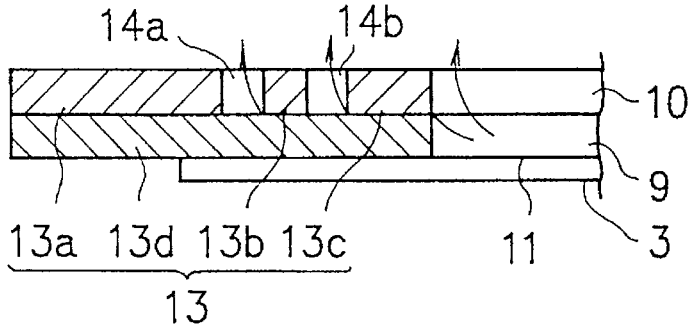
FIG. 3 is a partly enlarged sectional view of a second embodiment of the present invention.
Figure 4:
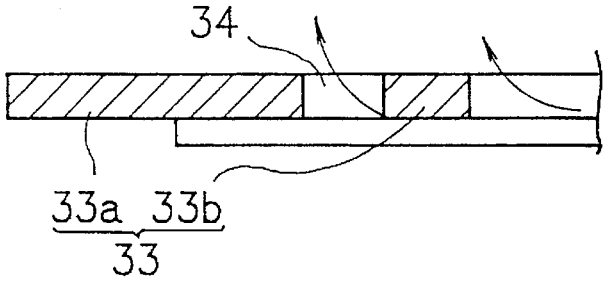
FIG. 4 is a partly enlarged sectional view of a third embodiment of the present invention.
Figure 5:
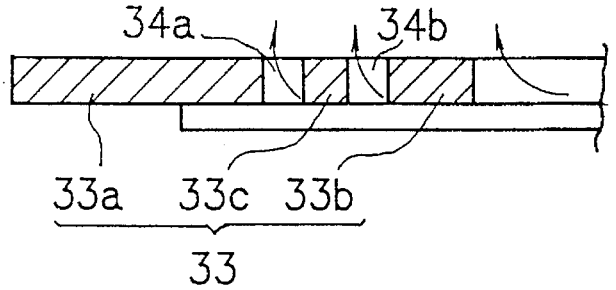
FIG. 5 is a partly enlarged sectional view of a fourth embodiment of the present invention.

FIG. 1 is a schematic sectional view showing the constitution of the rotary stencil printing machine of a first embodiment. FIG. 2 is a partly sectional view of FIG. 1. A printing drum 1 which is a cylindrical member is rotatable around the central axis of its own. The printing drum 1 has a cylindrical plate or stencil cylinder 2, a clamping device 4 for clamping the leading edge of a stencil sheet wrapped around the plate cylinder 2, and an ink supply means 5 provided inside the stencil cylinder 2.

The clamping device 4 has a base 6 of a nearly rectangular plate form provided nearly in parallel with the central axis of the printing drum 1. On the upper surface of the base 6 is disposed a shaft 7 in parallel with the central axis of the printing drum 1. On this shaft 7 is rotatably mounted a clamp plate 8 for clamping the leading edge part of the stencil sheet 3 between it and the base 6.

The stencil cylinder 2 comprises the outside first ink-pervious member 9 on which the original paper 3 is directly wrapped, and the inner second ink-pervious member 10 disposed under the first ink-pervious member 9. Both of the ink-pervious members 9 and 10 consists of a porous screen member with ink permeability. In the present embodiment, the outside first ink-pervious member 9 is made of a relatively fine-mesh screen member, while the inner second ink-pervious member 10 is produced of a relatively coarse-mesh screen member.

The stencil cylinder 2 constituted of the first and second ink-pervious members 9 and 10 has the first ink-pervious area 11 and the ink-impervious areas 12 and 13 disposed on both sides of the ink-pervious area 11 in the direction of rotation of the printing drum 1. The first ink-pervious area 11 corresponds to the perforated image area of the stencil sheet 3 wrapped around the peripheral surface of the stencil cylinder 2. The ink-impervious areas 12 and 13 are provided on both adjacent sides of the clamping device 4 relative to the direction of rotation of the printing drum 1, that is, on both edges of the ink-pervious area 11. Therefore, the leading and trailing edges of the stencil sheet 3 wrapped around the stencil cylinder 2 overlap either of the ink-impervious areas 12 and 13.

The inner second ink-pervious member 10, as shown in FIG. 2, has one belt-like second ink-pervious area 14 which is parallel with the axial line of the stencil cylinder 2 and two ink-impervious areas 13*a* and 13*b* disposed in parallel with the axial line of the stencil cylinder 2 for sandwiching the second ink-pervious area 14 from both sides, in the ink-impervious area 13 provided on the peripheral surface ahead of the clamping device 4 in the direction of rotation of the printing drum 1. The first ink-pervious member 9 does not have such a belt-like ink-pervious area 14 in the first ink-pervious member 9, and the ink-impervious area 13*d* covers the belt-like ink-pervious area 14 of the second ink-pervious member 10. Then, the trailing edge part of the stencil sheet 3 wrapped around the stencil cylinder 2 reaches the rear in the direction of rotation beyond the belt-like ink-pervious area 14.

The ink-impervious areas 12 and 13 (13*a*, 13*b*, 13*d*) are formed by impregnating and hardening a filling material such as silicone resin, polyurethane resin, etc., which is not affected by ink, in the first and second ink-pervious members 9 and 10. It can be investigated that the ink-impervious area 13*d* of the first ink-pervious member 9 and the ink-impervious areas 13*a* and 13*b* of the second ink-pervious member 10 may be bonded with an adhesive or a gluing agent, but it is desirable that surfaces to be bonded be mirror-finished, considering interchangeability of the ink-pervious member 9 required when deteriorated by printing.

The ink supply means 5 provided inside the stencil cylinder 2 has an ink supply roller 15 rotating in contact with the inner surface of the stencil cylinder 2, a inking roller 16 disposed near the ink supply roller 15, and an ink distributing means not shown for supplying the ink 30 between the ink supply roller 15 and the inking roller 16. The ink 30 supplied from the ink distributing means not shown is applied to the surface of the ink supply roller 15 by means of the inking roller 16 and is supplied to the inner peripheral surface of the stencil cylinder 2.

Outside and below the printing drum 1 is mounted an impression roller 17 as a back-up means of the printing drum 1. The impression roller 17 of the present embodiment is a cylindrical body which rotates in an opposite direction of the printing drum 1, on the center of an axial line parallel with the center axis of the printing drum 1.

During printing, the impression roller 17 moves up and down simultaneously with the rotation of the printing drum 1 in order that it will not interfere with the clamping device 4, and grips the printing paper 20 as a printing sheet, carrying it to the printing drum to accomplish printing on the printing paper 20.

In FIG. 1, a reference numeral 21 denotes a feed tray for loading the printing paper 20; 22 is a feed roller for feeding out the printing paper 20 from the feed tray 20; 23 refers to a pair of carrier rollers for carrying the printing paper 20 to the printing drum 1. In the drawing, 24 refers to a claw for stripping the printing paper 20 from the outer peripheral surface of the printing drum 1 after printing; and 25 is a receiving tray for receiving the printing paper 20 after printing.

With the stencil sheet 3 set in the rotary mimeograph apparatus of the present embodiment, printing is started. The ink 30 supplied by the ink supply roller 15 to the inner peripheral surface of the printing drum 1 is supplied to the stencil cylinder 2 through the ink-pervious area 11 of the first and second ink-pervious members 9 and 10, and transferred to the printing paper 20 through perforated image area of the stencil sheet 3 wrapped around the outer peripheral surface of the stencil cylinder 2.

The ink 30 not used in printing is sent backward in the direction of rotation with a pressure of contact between the printing drum 1 and the impression roller 17. As indicated by an arrow in FIG. 2, this surplus ink is partly sent back into the stencil cylinder 2 from the rear of the ink-pervious area 11 of the first and second ink-pervious members 9 and 10. Other part of the surplus ink is also returned into the stencil cylinder 2 through the belt-like second ink-pervious area 14 provided in the ink-impervious area 13 (13*a* and 13*b*) at the rear of the second ink-pervious member 10. Therefore, the surplus ink that has been sent backward in the direction of rotation of the printing drum 1 will not flow outwardly between the stencil sheet 3 and the stencil cylinder 2.

In the first embodiment thus explained, the ink-impervious area 13 provided in the rear peripheral surface in the direction of rotation of the printing drum 1 in relation to the clamping device 4 is composed of two ink-impervious areas 13*a* and 13*b* sandwiching one belt-like second ink-pervious area 14, and another ink-impervious area 13*d* covering these ink-impervious areas 13*a* and 13*b*. However, the number of the belt-like ink-pervious area 14 for returning the surplus ink into the stencil cylinder 2 is not limited to one and may be two or more. For example, as the second embodiment shown in FIG. 3, the ink-impervious area 13 of the second ink-pervious member 10 provided on the rear peripheral surface in the direction of rotation of the printing drum 1 may be composed of three ink-impervious areas 13*a*, 13*b* and 13*c* with the two belt-like second ink-pervious areas 14*a* and 14*b* disposed therebetween, and the ink-impervious area 13*d* of the first ink-pervious member 9 covering them.

Furthermore, in the first embodiment described above, the stencil cylinder 2 is composed of a two-layer ink-pervious member comprising the first ink-pervious member 9 and the second ink-pervious member 10. However, the stencil cylinder 2 of the printing drum 1 may have an ink-pervious member on which the stencil sheet 3 is wrapped; as in the third embodiment shown in FIG. 4, the ink-impervious area 33 provided on the rear peripheral surface in the direction of rotation of the printing drum may be composed of two ink-impervious areas 33*a* and 33*b* between which one belt-like second ink-pervious area 34 is interposed. Furthermore, as described in the fourth embodiment shown in FIG. 5, the ink-impervious area 33 provided on the rear peripheral surface in the direction of rotation of the printing drum 1 may be composed of three ink-impervious areas 33*a*, 33*b* and 33*c* in which the two belt-like second ink-pervious areas 34*a* and 34*b* are interposed.

Furthermore, in each embodiment described above, the ink-pervious members constituting the stencil cylinder of the printing drum are produced of a porous screen member, which, however, may include, as a component element of the stencil cylinder, a metallic cylindrical member having a multitude of fine pores; in this case it is advised that the ink-impervious area be formed without etching.

The rotary stencil printing machine according to the present invention is sufficient if provided with a clamping device for clamping the leading edge of the stencil sheet, an ink-pervious printing drum having an ink-impervious area in positions corresponding to the leading and trailing edge areas of the stencil sheet, and an impression roller mounted outside of the printing drum which grips and carries a printing sheet in cooperation with the printing drum.

For example, it is possible to apply the present invention to a rotary stencil printing machine such that a cylindrical printing drum has a flexible stencil cylinder; ink is supplied to the inner peripheral surface of this stencil cylinder; an inner impression roller is provided inside the printing drum to elastically deform the stencil cylinder outwards; outside of the printing drum is provided a back-up roller in parallel with the printing drum; and the printing paper is fed in between the stencil cylinder and the back-up roller, so that the printing paper is pressed by the flexible plate cylinder pushed outwardly by the ink supply roller.

Furthermore, it is also possible to apply the present invention to a rotary stencil printing machine provided with a rigid stencil cylinder such that a back-up roller is moved up and down in relation to the stencil cylinder, but not applied to a printing machine of the aforesaid constitution that the flexible plate cylinder is deflected outwards by means of the inner impression roller.

According to the rotary stencil printing machine of the present invention, there is provided the ink-pervious area in the rear ink-impervious area in the direction of rotation of the stencil cylinder, to thereby allow surplus ink back into the stencil cylinder, thus reliably preventing ink leakage from the printing drum to accomplish printing without smearing the printing paper and the printing machine with ink.

What is claimed is:

1. A rotary stencil printing machine, comprising:

a cylindrical member including a first ink-pervious member; a second ink-pervious member disposed beneath the first ink-pervious member; a center axis, said cylindrical member being rotatable around the center axis; a cylindrical peripheral surface adapted to mount thereon a stencil sheet having leading and trailing edge portions and an image forming area situated between the leading and trailing edge portions, said stencil sheet being wrapped on the first ink-pervious member; a first ink-pervious area formed on the peripheral surface on which the image forming area of the stencil sheet is disposed; at least one second ink-pervious area formed on the peripheral surface on which the trailing edge portion of the stencil sheet is disposed, said second ink-pervious area having an elongated shape continuously extending parallel to the center axis of the cylindrical member and being formed in the second ink-pervious member; at least two first ink-impervious areas formed on the peripheral surface, said first ink-impervious areas sandwiching the second ink-pervious area and being formed in the second ink-pervious member; a third ink-pervious area and a second ink-impervious area situated adjacent to the third ink-pervious area, said third ink-pervious area and second ink-impervious area being formed in the first ink-pervious member; a fourth ink-pervious area formed in the second ink-pervious member, said third and fourth ink-pervious areas forming said first ink-pervious area and said second ink-impervious area of the first ink-pervious member covering said at least one second ink-pervious area, a clamping device formed on the peripheral surface of the cylindrical member, said clamping device clamping the leading edge portion of the stencil sheet, ink supply means for supplying ink inside the cylindrical member, and back-up means provided outside the cylindrical member, said backup means adapted to grip a printing sheet together with the cylindrical member to transfer the same.

2. A rotary stencil printing machine according to claim 1, wherein said back-up means has a cylindrical body with an axis parallel to the axis of the cylindrical member, said cylindrical body rotating in a direction opposite to a direction of rotation of the cylindrical member.

3. A rotary stencil printing machine according to claim 2, wherein said first and second ink-impervious areas are formed of filling materials disposed over the first and second ink-pervious members.

4. A rotary stencil printing machine according to claim 3, wherein said first and second ink-impervious areas are joined together.

* * * * *